US009151034B2

(12) United States Patent
Jaeschke

(10) Patent No.: US 9,151,034 B2
(45) Date of Patent: Oct. 6, 2015

(54) TURNBUCKLE FOR JOINING STRUCTURAL ELEMENTS

(75) Inventor: Klaus Jaeschke, Magdeburg (DE)

(73) Assignee: B.T. INNOVATION GMBH, Magdeburg (DE)

( * ) Notice: Subject to any disclaimer, the term of this patent is extended or adjusted under 35 U.S.C. 154(b) by 141 days.

(21) Appl. No.: 13/138,142

(22) PCT Filed: Jan. 12, 2010

(86) PCT No.: PCT/EP2010/000106
§ 371 (c)(1),
(2), (4) Date: Aug. 15, 2011

(87) PCT Pub. No.: WO2010/081673
PCT Pub. Date: Jul. 22, 2010

(65) Prior Publication Data

US 2011/0293364 A1 Dec. 1, 2011

(30) Foreign Application Priority Data

Jan. 13, 2009 (DE) ..... 20 2009 000 481 U
Dec. 11, 2009 (EP) ..... 09015381

(51) Int. Cl.
*E04B 1/04* (2006.01)
*E04B 1/41* (2006.01)
*E04B 5/02* (2006.01)

(52) U.S. Cl.
CPC ..... *E04B 1/043* (2013.01); *E04B 1/4114* (2013.01); *E04B 5/023* (2013.01); *Y10T 29/49947* (2015.01); *Y10T 403/55* (2015.01)

(58) Field of Classification Search
CPC ..... E04B 1/043; E04B 1/1903; E04B 1/1906; E04B 1/1912
USPC ..... 403/300, 305, 306, 309; 52/582.1, 52/573.1, 291, 708, 223.7
See application file for complete search history.

(56) References Cited

U.S. PATENT DOCUMENTS 2,803,317 A * 8/1957 Henderson ..... 52/654.1
3,568,380 A 3/1971 Stucky
3,952,468 A * 4/1976 Soum ..... 52/223.13
(Continued)

FOREIGN PATENT DOCUMENTS

DE 1 684 247 3/1971
DE 1 817 882 A1 6/1973
(Continued)

OTHER PUBLICATIONS

Machine Translation of WO 88/01699 A1, http://worldwide.espacenet.com, 8 pgs, generated Dec. 29, 2014.*

*Primary Examiner* — Daniel Wiley
(74) *Attorney, Agent, or Firm* — Flynn, Thiel, Boutell & Tanis, P.C.

(57) ABSTRACT

A turnbuckle for joining structural elements, in particular prefabricated concrete parts, which is formed substantially in the shape of a shell and has a housing chamber accessible at least from outside via an access opening and, in addition, passage sections which are preferably located opposite one another and open into the housing chamber and which are preferably configured as passage openings for a fixing element to be pushed through. In addition, a kit for joining structural elements, method for joining structural elements, an arrangement for joining structural elements and a method for preparing structural elements.

4 Claims, 6 Drawing Sheets

(56) References Cited

U.S. PATENT DOCUMENTS

Figure 1:
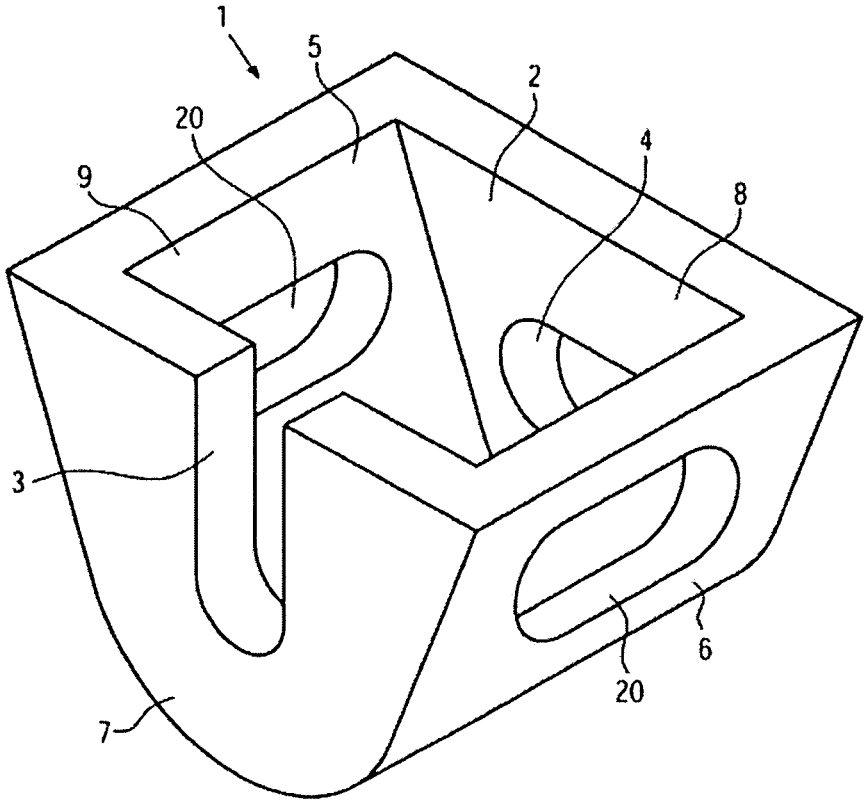

| | | | | |
|---|---|---|---|---|
| 4,023,315 | A | 5/1977 | Stucky | |
| 4,271,654 | A | 6/1981 | Jungbluth | |
| 4,324,037 | A * | 4/1982 | Grady, II | 29/469 |
| 4,484,430 | A | 11/1984 | Rossman | |
| 4,669,909 | A * | 6/1987 | Galan Inchaurbe | 403/190 |
| 4,796,389 | A * | 1/1989 | Bini et al. | 52/2.26 |
| 5,155,954 | A | 10/1992 | Roire | |
| 5,216,860 | A * | 6/1993 | Thomson et al. | 52/259 |
| 7,975,444 | B2 * | 7/2011 | Holdsworth et al. | 52/223.7 |
| 2006/0248811 | A1 | 11/2006 | Hansort | |
| 2009/0139177 | A1 * | 6/2009 | Holdsworth et al. | 52/713 |
| 2009/0183441 | A1 | 7/2009 | Azarin | |

FOREIGN PATENT DOCUMENTS

| | | | |
|---|---|---|---|
| DE | 23 30 675 | A1 | 2/1975 |
| DE | 24 09 073 | A1 | 9/1975 |
| DE | 10 2004 055 727 | A1 | 5/2006 |
| DE | 20 2008 011 575 | U1 | 11/2008 |
| FR | 1 182 383 | A | 6/1959 |
| FR | 2 298 720 | A1 | 8/1976 |
| FR | 2546988 | A1 * | 12/1984 |
| NL | 6 408 402 | A | 1/1966 |
| SU | 1560693 | A1 | 4/1990 |
| WO | WO 8801699 | A1 * | 3/1988 |
| WO | WO 2007/095422 | A2 | 8/2007 |

* cited by examiner

TURNBUCKLE FOR JOINING STRUCTURAL ELEMENTS

The present invention relates to a turnbuckle for joining structural elements, a kit for joining structural elements with a turnbuckle according to the invention, a method of joining structural elements with a turnbuckle according to the invention, an arrangement for joining structural elements, and a method of preparing structural elements into which the turnbuckle according to the invention will be inserted.

When new buildings are erected, prefabricated concrete parts are often used and joined on site. Here, stringent requirements are imposed on the connection. The connection is required to be quickly and inexpensively created and to be able to resist even high loads.

Up to now, boxes with reinforcement elements have been arranged in poured grooves of the structural elements. These reinforcement elements can consist e.g. of concrete steel. When the structural elements are put together, the reinforcement elements overlap. Joint mortar is poured over these overlapping reinforcement elements in the poured joint.

This method, however, is time consuming as quite some time will pass until the joint mortar has cured and the connection is loadable.

To be able to quickly erect new buildings, it is necessary that the structural elements can be quickly and securely joined on site.

It is the object of the invention to facilitate the joining of structural elements.

This object is achieved according to the invention by a turnbuckle for joining structural elements, in particular prefabricated concrete parts, which is formed substantially in the shape of a shell and has a housing chamber accessible at least from outside via an access opening and, in addition, passage sections which are preferably located opposite one another and open into the housing chamber and which are preferably configured as passage openings for fixing means to be pushed through.

The advantage of this solution is that structural elements, in particular prefabricated concrete parts, can be joined to each other quickly, rationally and securely. The connection can be loaded immediately upon fastening of the turnbuckle. No curing time is required. Thus, the turnbuckle according to the invention highly facilitates the assembly of concrete elements and results in a clear saving of time on site. Moreover, the turnbuckle according to the invention can be rationally fabricated in series with high precision.

It can be advantageous if the turnbuckle comprises at least two contracting, preferably tapering side walls. This has the advantage that the clearance required for the rotating motion of a tightening tool when threaded joints are created is provided and that higher mechanical toughness is achieved by the special geometric shape of the turnbuckle.

If at least two side walls are essentially planar and are lying opposite one another, preferably in parallel, a linear load transfer in the direction of pull is given.

It can be furthermore advantageous if the passage sections are formed in the plane side walls as assembly is still further facilitated in this manner.

It can be moreover advantageous if the contracting side walls are joined to each other such that the cross-section has a V- or U-shape. In this manner, the insertion of a tightening tool when threaded joints with the structural elements are created can be still further facilitated.

In an advantageous further development of the invention, the passage sections can be preferably offset by 90° and be configured as a slot and/or oblong hole, and one of the passage sections can be preferably configured as a slot and another one of the passage sections can be embodied as an oblong hole. This construction permits an even easier and quicker assembly of the turnbuckle, and, in the assembly process, compensates tolerances of the fixing points that arise in the fabrication of the structural elements.

If the slot is open at least on one side and preferably opens into the access opening, assembly can be still further facilitated.

It can also prove to be advantageous for the turnbuckle to consist, at least in sections, of plastics and/or metal, and preferably of steel casting. In this manner, the stability of the turnbuckle can be still further increased.

The object is also achieved by a kit for joining structural elements, in particular prefabricated concrete parts, with at least one turnbuckle according to the invention and at least one anchorage, preferably a pigtail anchor.

The advantage of this solution is that a clear saving of time can be achieved on site as no curing time is required and the joint of the structural elements can be loaded immediately upon assembly of the turnbuckle.

It can be advantageous for the kit to furthermore comprise at least one recess former which is preferably provided for being fixed to a mold element for manufacturing a structural component and which is furthermore provided for retaining at least one anchorage, preferably a pigtail anchor, which is provided for being inserted into the structural component. This has the advantage that the structural elements can be prepared for receiving the turnbuckle according to the invention already in the works.

It can be advantageous for the recess former to consist, at least in sections, of metal and/or plastics and to be preferably magnetic at least in sections. In this manner, the recess former can be even more easily mounted to a mold element and also removed again. Moreover, an even more secure placing of the recess former is possible.

In an advantageous further development of the invention, the kit can furthermore comprise a sealing means, preferably a sealing tape, which is provided for being inserted between the structural elements before the latter are joined. By the use of such a sealing means, an even higher water and gas tightness of the joints between the structural elements is achieved.

The above object is moreover achieved by a method of joining structural elements, in particular prefabricated concrete parts, comprising the following steps:

assembling structural elements, provided each with at least one recess and one anchorage, preferably a pigtail anchor, so that the recesses are lying opposite the structural elements to be joined, inserting the turnbuckle according to the invention into the recesses of the structural elements, inserting the fixing means into the housing chamber through the access opening and into one anchorage each, preferably a pigtail anchor, through one passage opening each of the turnbuckle, fixing the fixing means.

The advantage of this solution is that the assembly of the structural elements is highly facilitated and a high precision is achieved in the fabrication. Moreover, a clear saving of time on site is possible. The structural elements can thus be rationally and quickly joined. The fastening of the structural elements is possible without any additional material and particular contrivances.

If a sealing means, preferably a sealing tape, is inserted between the sides of the structural elements to be joined before they are joined, the water and gas tightness of a joint between the joined structural elements can be increased.

Moreover, it can prove to be advantageous for the thickness of the structural elements to be greater than the depth of the recess. This permits an even better sealing of the structural elements.

Moreover, it can prove to be advantageous if in the joined state of the structural elements, the sealing means extends behind the turnbuckle, as sealing can be even further increased thereby.

The above object is furthermore achieved by an arrangement for joining structural elements, in particular prefabricated concrete parts, with at least one turnbuckle according to the invention, at least two structural elements which each comprises at least one recess into which the turnbuckle can be inserted, and one anchorage, preferably a pigtail anchor, which is accessible via the recess, and with fixing means.

The advantage of this solution is that a rational and quick, and moreover secure, joint of structural elements, which is moreover secure, is possible. In this manner, costs and time can be saved.

It can be advantageous if the arrangement additionally comprises a sealing element, preferably a sealing tape, which is provided for being inserted between the sides of the structural elements to be joined before the latter are joined. In this manner, the water and gas tightness of a connection between the joined structural elements can be increased.

Moreover, the above object is achieved by a method of preparing structural elements, preferably prefabricated concrete parts, into which the turnbuckle according to the invention is to be inserted, comprising the following steps:

attaching a recess former to a mold element, the recess former being preferably magnetic at least in sections and retaining at least one anchorage, preferably a pigtail anchor, filling the mold element with a filler, preferably with concrete, allowing the filler to cure, removing the mold element and the recess former.

This solution has the advantage that the structural elements can be prefabricated with high precision and quickly and securely joined on site by the turnbuckle according to the invention without any additional material.

The invention will be illustrated more in detail below with reference to an embodiment and corresponding drawings.

Figure 2:
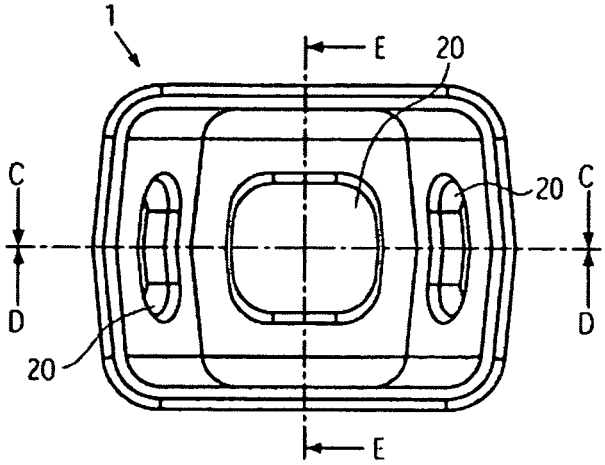
Figure 3:
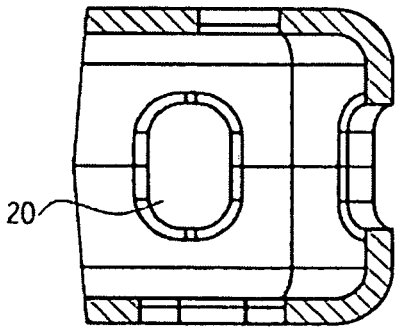
Figure 4:
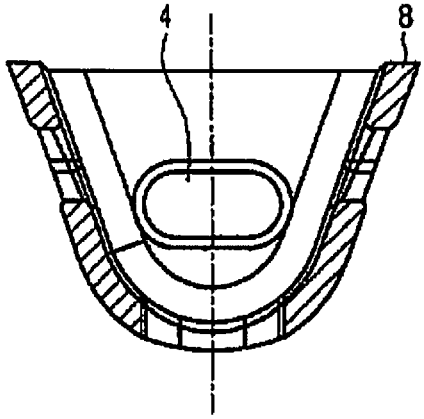
Figure 5:
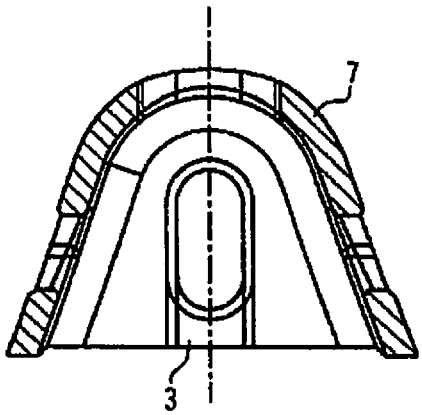
Figure 6:
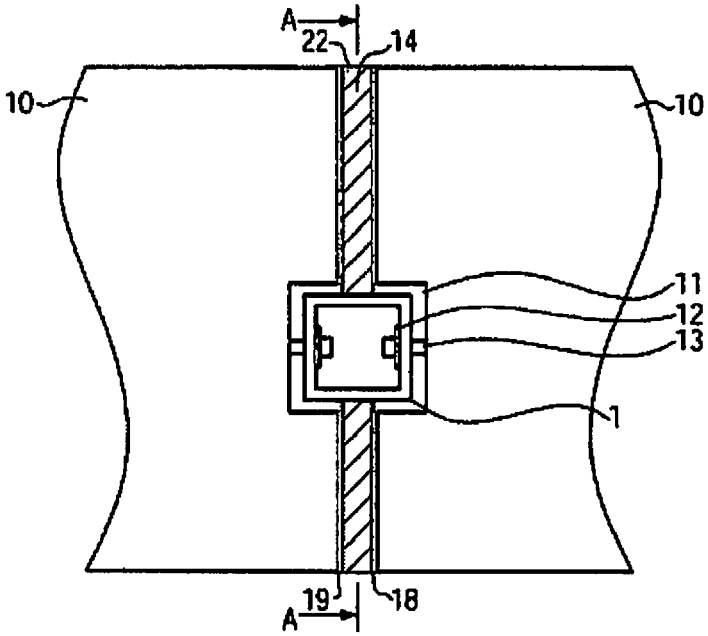
Figure 7:
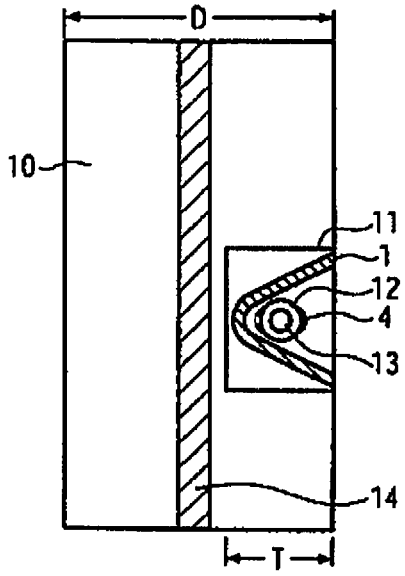
Figure 8:
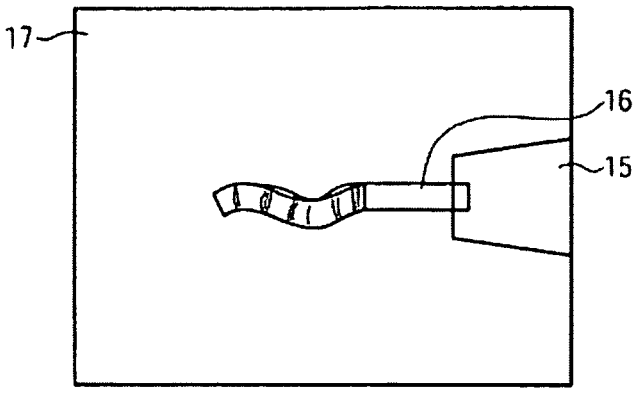
Figure 9:
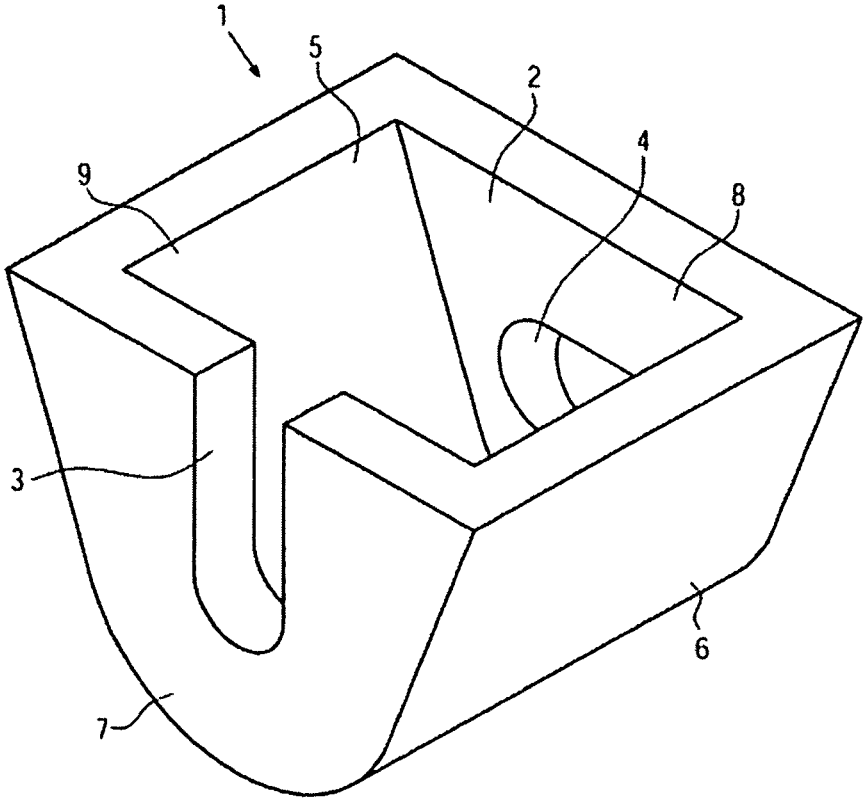

These drawings show:

FIG. 1 a schematic representation of the turnbuckle according to the invention with access openings, FIG. 2 a plan view of the turnbuckle according to the invention, FIG. 3 a sectional view of FIG. 2 along line E-E, FIG. 4 a sectional view of FIG. 2 along line D-D, FIG. 5 a sectional view of FIG. 2 along line C-C, FIG. 6 a schematic representation of two structural elements with a sealing tape and the inserted turnbuckle, FIG. 7 a sectional view of FIG. 6 along line A-A, FIG. 8 a mold element with a recess former and a pigtail anchor, FIG. 9 a schematic representation of the turnbuckle according to the invention without access openings.

FIG. 1 shows a schematic representation of the turnbuckle 1 according to the invention for joining structural elements 10, in particular prefabricated concrete parts 10 (cf. FIG. 6). As can be taken from FIG. 1, the turnbuckle 1 is substantially formed in the shape of a shell and has a housing chamber 2 accessible from outside via an access opening 9. Moreover, the turnbuckle 1 has two opposite passage openings 3, 4 (offset by 90°) opening into the housing chamber 2 for fixing means, such as bolts 13, to be pushed through (cf. FIG. 6). In the present embodiment, one passage opening 3 is configured as a slot 3 which is open on one side and opens into the access opening 9. The other passage opening 4 is, in the present embodiment, configured as an oblong hole 4. The slot 3 and the oblong hole 4 are embodied in the plane side walls 7, 8 lying opposite one another.

The number, design and arrangement of the passage openings 3, 4 shown in the embodiment are to be understood as an example only. For a more effective assembly and better compensation possibility of the connecting points exhibiting tolerances due to manufacturing, the plane side walls 7, 8 of the turnbuckle 1 can be each provided e.g. with a slot 3, or a slot and/or an oblong hole, respectively, or with two oblong holes offset by 90°.

The side walls 5, 6 are configured to be contracting, i.e. tapering and curved.

The conical side walls 5, 6 are, in the present embodiment, integrally formed and have a U-shaped cross-section. The integrally formed design of the conical side walls 5, 6, however, is only given by way of example. As an alternative, the conical side walls 5, 6 can also be embodied as individual side walls which are connected to one another. A V-shaped cross-section is also conceivable.

For saving weight, access openings 20, here configured as recesses 20, are provided in the conical side walls 5, 6 and in the bottom 21 of the turnbuckle 1 (cf. FIG. 2). The arrangement and number of the access openings 20 depends on the respective circumstances. To achieve a particularly high stability of the turnbuckle 1, it is also conceivable not to provide any access openings 20 (cf. FIG. 9). If required, access openings can be also arranged only or additionally in the plane side walls 7, 8.

Due to the conical design of the side walls 5, 6, the clearance, which is required for the rotating motion of a non-depicted tightening tool when a threaded joint is created, is provided.

The turnbuckle 1 consists, at least in sections, of plastics and/or metal, and preferably of steel casting. A highly loadable steel casting guarantees the transfer of the occurring tensile and shearing forces and moreover ensures a rational and inexpensive manufacture of the turnbuckle 1. By its geometric shape and the arrangement of the passage openings 3, 4, which can also be considered as recesses 3, 4, for the threaded joints, the turnbuckle 1 according to the invention receives the occurring tensile and shearing forces for the connection with the corresponding structural elements 10 to be created (cf. FIG. 6). Instead of threaded joints, other suited joints are also possible.

FIG. 2 shows a plan view of the turnbuckle 1. One can particularly clearly see the access openings 20 in FIG. 2. FIG. 3 also particularly clearly shows an access opening 20. FIG. 4 shows the planar side wall 8 with the oblong hole 4, and FIG. 5 shows the planar side wall 7 with the slot 3. Moreover, the opening angle of the side wall 7 is stated to be 38.8° in FIG. 5. This angle is to be understood as an example only and can be adapted to the circumstances.

FIG. 6 shows two structural elements 10 with one recess 11 each in which the turnbuckle 1 according to the invention is inserted. The turnbuckle 1 is fixed to a structural component 10 with a bolt 13 and a washer 12 each. A sealing tape 14 is located between the sides 18, 19 of the structural elements 10 to be joined. As can be taken from FIG. 6, the sealing tape 14 extends behind the turnbuckle 1.

In connection with an elastic sealing tape 14, preferably with swelling capacity, of natural or synthetic rubber and/or on the basis of bitumen, as it is known, for example under the trade name RubberElast®, the turnbuckle 1 according to the invention can also be employed for many diverse structural solutions with prefabricated concrete parts in the field of waterproof elements. As can be taken from FIG. 6, the sealing tape 14 is attached in the joined region of the structural elements 10 to be joined and is compressed by the initiated fastening process by means of the turnbuckle 1. Assembly and sealing are reduced to one processing step. Ideally, the sealing tape 14 is self-adhesive and will permanently elastically adhere to the concrete element 10 by the contact pressure. Directly upon assembly, the connection 22 between the concrete elements 10 is impermeable to presswater. Other embodiments of the sealing tape 14 which are not self-adhesive are conceivable.

Thanks to the extremely high water and gas tightness of the material, but also due to its mechanical and chemical resistance, a sealing tape 14, such as RubberElast®, is an ideal solution for the sealing of connections in prefabricated waterproof parts. Tanks, shafts, channels, but also waterproof cellars in residential building are thus not only securely sealed, but also particularly quickly and inexpensively mounted.

Apart from RubberElast®, other sealing tapes or sealing means are also conceivable. The sealing tape 14 used ideally exhibits, apart from an extremely high water and gas tightness, very good adhesion, quick processing without the need for any tool, and is watertight immediately upon assembly. Depending on the application, the sealing tape 14 should be flexible and resistant to acid, caustic solutions, salt and liquid manure even at low temperatures. Moreover, the sealing tape 14 should be weathering resistant and generally inspected by the construction supervision. Depending on the application, the sealing tape 14 does not have to exhibit all listed properties.

The bolt 12 of FIG. 6 is connected with a pigtail anchor 16 (cf. FIG. 8) which is located in the component 10.

FIG. 7 shows a sectional view of FIG. 6 along line A-A. One can particularly clearly see in this figure that a thickness D of the component 10 is greater than a depth T of the recess 11. It is moreover shown that the sealing tape 14 is lead past and behind the turnbuckle 1. Furthermore, the oblong hole 4, the washer 12 and the bolt 13 are represented.

FIG. 8 shows a mold element 17 with a recess former 15 and the pigtail anchor 16.

Usually, a shuttering consists of two mold elements 17 between which the filler, e.g. concrete, is filled in. In FIG. 8, only one mold element 17 is represented. The pigtail anchor 16 proved to be particularly advantageous and is approved by the construction supervision for constant load application. However, other suited anchorages are also conceivable. The recess former 15 has conical side walls to make it easier to remove them from the prefabricated concrete part. The concrete design of the recess former can be adapted to the conditions. The recess former 15 is advantageously magnetically attached to the mold element 17. This permits an easy attachment of the recess former 15 to the mold element 17. It is also conceivable to clamp the recess former 15 between two mold elements 17 or to fix it with bolts or nails. Other suited methods of fixing are also conceivable. As can be seen in FIG. 8, the pigtail anchor 16 is partially inserted into the recess former 15. Thus, the pigtail anchor 16 is fixed to the mold element 17 while the concrete is being filled in.

The kit according to the invention for joining structural elements 10, which can also be referred to as a fastening or clamping system, comprises the turnbuckle 1 according to the invention and at least one anchorage 16. Furthermore, the kit can comprise at least one recess former 15 as described above and at least one anchorage 16, such as the above-described pigtail anchor 16, which is provided for being inserted into the structural component 10. In addition, if a particularly tight connection between the structural elements 10 is required, the kit can comprise a sealing means 14, such as the above-described sealing tape.

This sealing tape 14 will be inserted between the sides 18, 19 of the structural elements 10 to be joined before the structural elements 10 are joined.

According to the inventive method of joining structural elements 10, such as prefabricated concrete parts 10, first the structural elements 10, which each comprise at least one recess 11, are assembled such that the recesses 11 of the structural elements 10 to be joined are lying opposite one another. Ideally, one anchorage 16, e.g. the above-described pigtail anchor 16, is already embedded in the structural component, e.g. the prefabricated concrete part 10.

Then, the turnbuckle according to the invention is inserted into the recesses 11 of the structural elements 10. Subsequently, the bolts 13 are inserted through the access opening 9 into the housing chamber 2 and through one passage section 3, 4, each, such as the slot 3 or the oblong hole 4 of the turnbuckle 1, into the anchorage. Due to the design of the slot 3 or the oblong hole 4, respectively, an effective assembly and better compensation possibility of the connection points, which exhibit tolerances due to manufacturing, are possible.

The turnbuckle 1 is then fixed with the bolts 13 and the washers 12. Then, the bolts 13 are tightened e.g. with a ring ratchet or with a torque wrench, respectively.

This sequence is only to be considered as an example and can also be changed. For example, it is conceivable that the anchorages are not installed into the structural elements already in the works, but are inserted on site.

If a water and/or gas tight connection is desired, it is required to insert a sealing means 14 between the sides 18, 19 of the structural elements 10 to be joined. Here, the use of a sealing tape 14, such as RubberElast®, is particularly advantageous.

If this sealing tape 14 extends behind the turnbuckle 1 in the joined state of the structural elements 10, a particularly good sealing is possible.

The arrangement according to the invention for joining structural elements 10 comprises at least one turnbuckle 1 according to the invention, two structural elements 10 which each comprise at least one recess 11 into which the turnbuckle 1 can be inserted, and one anchorage 16, preferably a pigtail anchor 16, which is accessible via the recess 11, and fixing means 13. Moreover, the arrangement can comprise the above-described sealing tape 14, if a tight connection is desired.

In the method according to the invention for the preparation of structural elements 10, such as prefabricated concrete parts 10 into which the turnbuckle 1 according to the invention is to be inserted, at least one recess former 15 is first attached to the mold element 17. Easy assembly and disassembly of the recess former 15 is possible if the latter is magnetically attached to the mold element 17. However, other fixing means, such as bolts or clamps, are also conceivable. This recess former 15 retains at least one anchorage 16, such as a pigtail anchor 16. After the recess former 15 with the anchorage 16 has been attached, the mold element 17 is filled with a filler, e.g. concrete. In FIG. 8, only one mold element 17 is represented. For filling, however, two mold elements 17 are required. After the filler has mired, the mold elements 17 and the recess former 15 are removed. The anchorage 16, which was removably fixed in the recess former 15, remains in the structural component 10.

The present invention relates to a turnbuckle 1, which can also be referred to as fastening or clamping means, for assembling a permanent connection of prefabricated concrete parts 10 or similar structural elements of other suited materials. By its configured specific shape and the arranged fixing means, such as screwing devices, in particular bolts, this turnbuckle 1 permits the fastening and quick rational assembly and permanent structural connection of prefabricated concrete parts 10, e.g. prefabricated reinforced concrete parts 10 or structural elements 10 of other suited materials. The special geometric shape of the turnbuckle 1 permits the assembly and permanent connection of the concrete elements 10 or prefabricated concrete parts 10, respectively via threaded joints and pigtail anchors 16 or anchor sleeves, respectively, that are embedded in the concrete elements 10. The turnbuckle 1 according to the invention thus highly facilitates the assembly of prefabricated concrete parts 10, promises high precision in the manufacture and a clear saving of time on site.

Possible fields of application are here, among other fields, the stable and permanent connection of floor and ceiling slabs, sandwich elements, double walls, and angle brackets.

Apart from the employment as structural connecting element, the turnbuckle 1 is provided for the systematic and permanent transmission of tensile and shearing forces with mainly dead loads.

The fastening system consists of a turnbuckle 1 according to the invention and anchorages 16, such as pigtail anchors 16, which are provided for being embedded into the prefabricated concrete parts 10. Two versions are conceivable which can be loaded with tensile forces of up to 50 kN or 100 kN. These data are only to be considered as examples. Depending on the circumstances, versions with lower or higher tensile forces are also conceivable.

As was already described in detail above, for the preparation of the fastening point in the works, there exist pigtail anchors 16 or anchor sleeves and recess formers 15 that can be magnetically fixed on the mold element 17 or a pallet, respectively, and which, e.g., at least partially consist of plastics. These recess formers 15 can be positioned with only a few movements of the hand. On site, the concrete elements 10 are put together, the turnbuckle 1 is inserted, fastened with the associated bolts 13 and thus structurally joined.

In particular, prefabrication can be accomplished with precise fit in the works where the prefabricated concrete parts are prepared. The exact positioning of the pigtail anchors or anchor sleeves, respectively, and the formation of the recess is accomplished by means of the magnetic recess formers in only one step.

A sealing tape 14, such as RubberElast®, is simply pressed onto the concrete in the region of the butt joint during assembly. In the ideal case, this sealing tape 14 is self-adhesive. A protective strip of the sealing tape 14 is removed, and the next concrete element 10 is pressed against the sealing tape 14.

The turnbuckle is inserted and fixed with the bolts and washers or shims, respectively.

Finally, the bolts are tightened with a ring ratchet or torque wrench.

The fastening system offers many universal application possibilities, for example in the assembly of angle brackets which find application in road construction and civil engineering, in garden making and landscape work as well as in the field of coast protection, and in the joining of floor slabs, shaft parts, ceiling and wall panels, and many other structural prefabricated concrete parts.

The advantages of the turnbuckle according to the invention consist in the rational and quick joining of structural elements 10, the fastening of the structural elements 10 without any additional materials and particular contrivances. Moreover, the turnbuckle can be combined with all approved anchor systems and has a low own weight. Complex individual solutions can be eliminated with the turnbuckle according to the invention. By the magnet technique (recess former 15 can be magnetically attached to the mold element 17), exact positioning is possible in the manufacturing process.

The use of a sealing tape 14, such as RubberElast®, ensures an extremely high water and gas tightness, very good adhesion and quick processing without the need for any tool. The connection is watertight immediately upon assembly. Moreover, the sealing tape is flexible and resistant to acids, caustic solutions, salt and weathering, even at low temperatures.

The invention claimed is:

1. A turnbuckle for joining first and second prefabricated concrete parts, said turnbuckle comprising:

an open housing chamber formed by first and second opposed planar sidewalls which are substantially parallel to each other, third and fourth opposed side walls which extend away from each other as they extend vertically upward, a bottom wall joining the first, second, third and fourth sidewalls and an access opening provided at the top of the chamber, wherein elongate passage sections are provided in the first and second sidewalls which open into the housing chamber and are configured as a slot and/or an oblong hole, each of the third and fourth sidewalls joins the first and second side walls and the elongate passage sections provided in the first and second sidewalls are offset in orientation by 90° with respect to each other, one of the elongate passage sections being provided in the first or second sidewall as a slot which is open into the access opening and the other elongate passage section is provided in the opposite sidewall as an oblong hole, each elongate passage section configured to receive a bolt extending from one of the first and second prefabricated concrete parts.

2. The turnbuckle according to claim claim 1, wherein a cross-section of the third and fourth walls and the bottom wall has a V-shaped or U-shaped profile.

3. The turnbuckle according to claim 1, wherein at least sections thereof consist of a plastic or a metal.

4. The turnbuckle according to claim claim 1, wherein at least sections thereof consist of a steel casting.

* * * * *